United States Patent [19]

Ampferer

[11] Patent Number: 4,805,566

[45] Date of Patent: Feb. 21, 1989

[54] ARRANGEMENT FOR INFLUENCING THE CONTROL TIMES OF VALVES

[75] Inventor: Herbert Ampferer, Sachsenheim, Fed. Rep. of Germany

[73] Assignee: Dr. Ing. h.c.f. Porsche AG, Fed. Rep. of Germany

[21] Appl. No.: 116,866

[22] Filed: Nov. 5, 1987

[30] Foreign Application Priority Data

Nov. 7, 1986 [DE] Fed. Rep. of Germany ..... 3638087

[51] Int. Cl.[4] ..... F01L 1/34; F02D 13/02

[52] U.S. Cl. ..... 123/90.15; 123/90.31

[58] Field of Search ..... 123/90.15, 90.17, 90.18, 123/90.31, 90.27

[56] References Cited

U.S. PATENT DOCUMENTS

| | | | |
|---|---|---|---|
| 3,878,822 | 4/1975 | Beal | 123/90.15 |
| 4,741,299 | 5/1988 | Matsuura et al. | 123/90.31 |

FOREIGN PATENT DOCUMENTS

| | | | |
|---|---|---|---|
| 0147209 | 7/1985 | European Pat. Off. . | |
| 3509094 | 10/1985 | Fed. Rep. of Germany | 123/90.15 |
| 0159904 | 10/1982 | Japan | 123/90.31 |
| 0166705 | 8/1985 | Japan | 123/90.13 |

*Primary Examiner*—Willis R. Wolfe
*Assistant Examiner*—M. Macy
*Attorney, Agent, or Firm*—Barnes & Thornburg

[57] ABSTRACT

A cam control connection arrangement is disclosed for influencing the control times of inlet valves of an internal combustion engine. The internal combustion engine comprises two parallel camshafts that per cylinder actuate two inlet valves and two outlet valves. The camshaft for the outlet valves, with the insertion of the cam control connection arrangement, drives the other camshaft by means of which the inlet valves are actuated.

9 Claims, 1 Drawing Sheet

ARRANGEMENT FOR INFLUENCING THE CONTROL TIMES OF VALVES

BACKGROUND AND SUMMARY OF THE INVENTION

The invention relates to a cam control connection arrangement for influencing the control times of valves of an internal combustion engine, in which case the arrangement has two devices that are arranged coaxially with respect to one another and are equipped with machine elements that transmit rotating motions, of which one device is radially adjustable with respect to the other device and interacts with a camshaft actuating the valves.

In the case of a known arrangement of the initially mentioned construction described in European Patent Application (EP-A) No. 0 147 209, the devices interact with the crankshaft on the one hand and with the camshaft on the other hand, in which case the arrangement is arranged as an extension of the camshaft.

An internal combustion engine is also disclosed in German Published Unexamined Application (DE-OS) No. 34 21 028 in which two camshafts that are arranged in parallel to one another and that per cylinder actuate two inlet valves and two outlet valves, are driven by means of a chain. A chain adjuster is provided between the load end and the loose end of the chain.

It is an objective of the invention to arrange the cam control connection arrangement in such a way that, on the one hand, two parallel camshafts of an internal combustion engine are driven and, on the other hand, the control times of the valves can be influenced.

According to the invention, this objective is achieved by disposing the cam control connection arrangement between two camshafts disposed above the valves in a cylinder head.

Primary advantages that can be achieved by means of the invention are that the cam control connection arrangement serves not only as a connecting element between the two camshafts, but also influences the control times of the valves, preferably the inlet valves. The arrangement, because of its location between the camshafts, requires little space. In preferred embodiments, the cam control connection arrangement is disposed completely below the plane passing through the camshaft axes.

In preferred embodiments of the invention, the cam control connection arrangement is held in bearings in an easily mountable and well supported way. Finally, the tensioning elements between the loose end and the load end of conventional camshaft chain drives are not required because of the construction of the cam control connection arrangement.

Other objects, advantages and novel features of the present invention will become apparent from the following detailed description of the invention when considered in conjunction with the accompanying drawings.

DETAILED DESCRIPTION OF THE DRAWINGS

Figure 1:
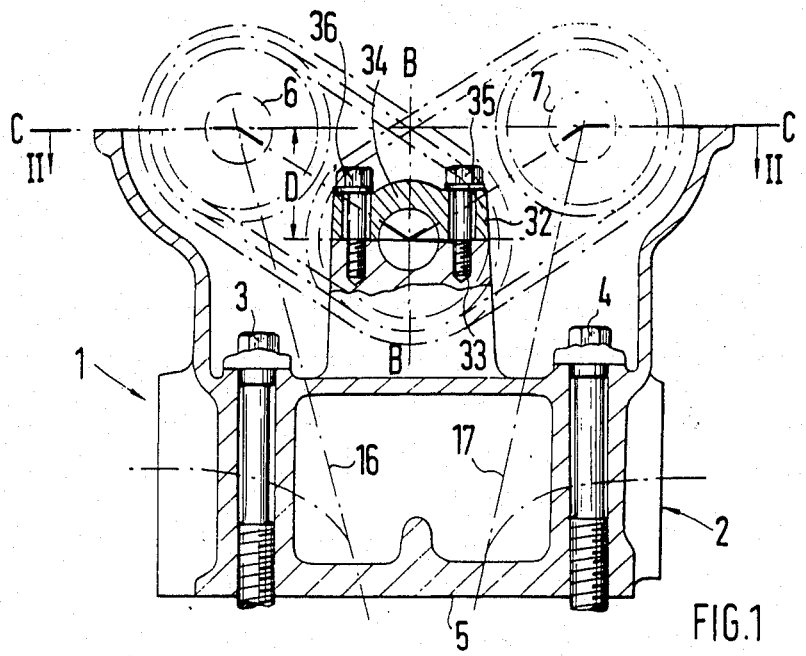
FIG. 1 is a partial cross-sectional view of an internal combustion engine in the area of a cylinder head with two parallel camshafts, constructed in accordance with a preferred embodiment of the invention.

A cylinder head 2 is shown of a multi-cylinder internal combustion engine 1. This cylinder head 2 is fastened by means of screws 3, 4 at an engine housing that is not shown and comprises the cylinder and the crankspace. A junction plane 5 is provided between the cylinder head 2 and the housing.

The cylinder head 2 is developed for receiving two parallel camshafts 6, 7. Bearings 8, 9, as well as 10, 11 are used for this purpose. On both sides of the bearing 9, the camshaft 7 has cams 12, 13 that interact with two inlet valves per cylinder. The inlet valves are not shown. The other camshaft 6 comprises cams 14, 15, that are mounted at both sides of the bearing 11. The cams 14, 15 interact with two outlet valves per cylinder that are also not shown. The inlet and outlet valves extend on axes 16, 17 that extend in a V-shape with respect to one another. It should be understood that the camshafts 6 and 7 extend over further engine cylinders and have cams for controlling inlet and outlet valves for such further cylinders, FIG. 2 only showing one end portion of the cylinder head 2 and associated cam structure.

The drive of the camshaft 6 takes place by means of an element 18—toothed wheel or chain wheel that transmits rotating motions and via a continuous element 19—chain, toothed belt—is in driving connection with a crankshaft of the internal combustion engine 1 that is not shown. By means of an inserted cam control connection arrangement 20, the camshaft 6 drives the camshaft 7.

By means of the cam control connection arrangement 20, via adjusting details of an embodiment that could be utilized being described in the mentioned EP-A No. 0 147 209, the camshaft 7 is developed to be adjustable for the purpose of influencing the control times of the inlet valves; in other words, the camshaft 7 may have different adjusted relative rotating positions relative to the camshaft 6.

Figure 2:
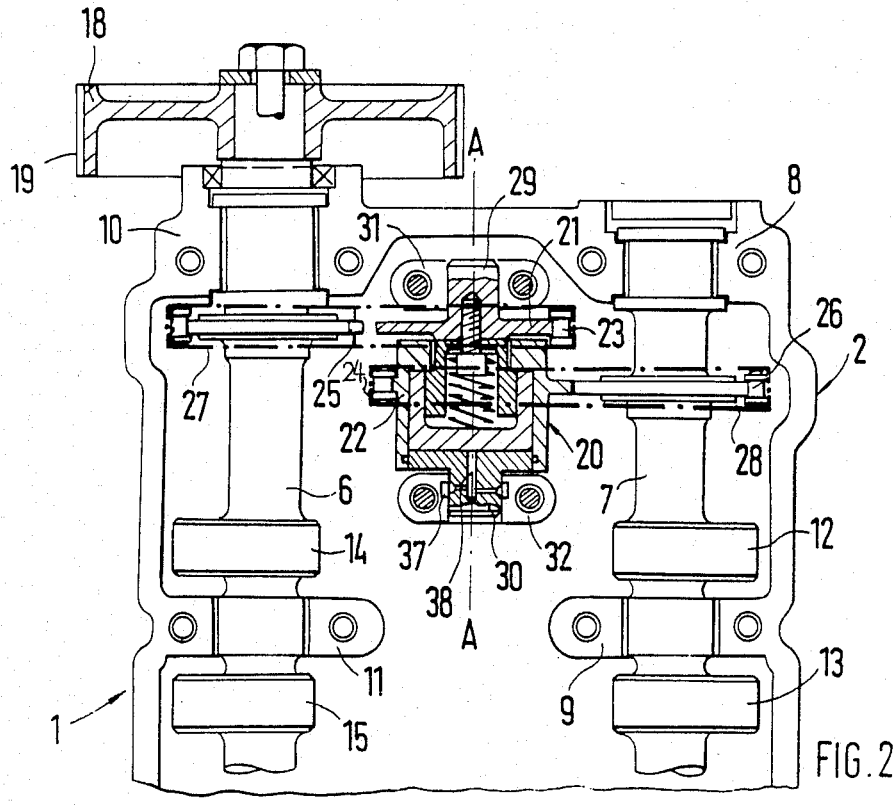
FIG. 2 is a partial sectional view taken along Line II—II of FIG. 1.

The cam control connection arrangement 20 has devices 21, 22 that are equipped with torque-transmitting machine elements 23, 24 (=toothed wheels, belt wheels) and interact with corresponding machine elements 25, 26 of the camshaft 6 and 7 via continuous elements 27, 28, such as chains, belts or the like that are developed as equal parts. The central longitudinal axis A—A of the devices 21, 22 rotating in the operation of the internal combustion engine 1 is located on a central longitudinal plane B—B between the camshafts 6, 7. In addition, the central longitudinal axis A—A is offset—distance D—relative to a central transverse plane C—C of the camshafts 6, 7. For the purpose of saving space, in the preferred illustrated embodiment, the central A—A is disposed closer to the cylinders of the housing or of the junction plane 5 than is the central transverse plane C—C of the camshafts 6, 7. FIGS. 1 and 2 schematically depict the location and relative sizes of the camshafts/drives and the cam control connection arrangement resulting in an optimum use of available space.

For the holding of the cam control connection arrangement 20, it is equipped with bearing journal ends 29, 30 that extend coaxially with respect to the devices 21, 22 and are received by bearings 31, 32 of the cylinder head 2. Each bearing 31 or 32 has a bearing seat 33 and a cap piece 34 that is held at the bearing seat 33 by means of screws 35, 36. The bearing seat 33 is firmly connected with the cylinder head 2.

The radial adjustment of the device 22 and of the camshaft 7 for varying the control times of the inlet valves relative to the outlet valves takes place hydraulically, namely as a function of the load of the internal combustion engine, in which case the hydraulic oil is fed to the arrangement 20 via oil ducts 37, 38 in the bearing 32 or bearing journal end 30.

Although the present invention has been described and illustrated in detail, it is to be clearly understood that the same is by way of illustration and example only, and is not to be taken by way of limitation.

What is claimed:

1. A cam control connection arrangement for influencing the control times of valves of an internal combustion engine, comprising two devices that are arranged coaxially with respect to one another and are equipped with machine elements for transmitting rotating motions, one device being radially adjustable with respect to the other device and interacting with camshaft actuating engine valves, wherein the cam control connection arrangement is disposed between two camshafts located above the valves in a cylinder head, and is connected by means of the machine elements of the devices with corresponding machine elements of the camshafts.

2. An arrangement according to claim 1, wherein the machine elements of the devices and of the camshafts interact by means of continuous elements.

3. An arrangement according to claim 2, wherein the central longitudinal axis A—A of the devices is located on a central longitudinal plane B—B between the camshafts.

4. An arrangement according to claim 2, wherein the two continuous elements are identical parts.

5. An arrangement according to claim 2, wherein the central longitudinal axis A—A of the devices is offset (distance D) relative to a joint central transverse plane C—C of the camshaft.

6. An arrangement according to claim 5, wherein the central axis A—A of the devices is located closer to the cylinder of the internal combustion engine than is the joint central transverse plane C—C of the camshafts.

7. An arrangement according to claim 1, wherein bearing journal ends that extend coaxially to the devices are provided, said bearing journal ends being held in bearings of the cylinder head.

8. An arrangement according to claim 7, wherein each bearing has a bearing seat and a cap piece that is fastened at said bearing seat by means of screws.

9. An arrangement according to claim 7, wherein oil ducts are provided in the bearing or the bearing journal end for supplying hydraulic control oil.

* * * * *